US008744281B2

(12) United States Patent
Kato et al.

(10) Patent No.: US 8,744,281 B2
(45) Date of Patent: Jun. 3, 2014

(54) IMAGE FORMING APPARATUS

(75) Inventors: Koji Kato, Tokyo (JP); Yoichi Hayakawa, Tokyo (JP)

(73) Assignee: Oki Data Corporation, Tokyo (JP)

( * ) Notice: Subject to any disclaimer, the term of this patent is extended or adjusted under 35 U.S.C. 154(b) by 135 days.

(21) Appl. No.: 13/402,971

(22) Filed: Feb. 23, 2012

(65) Prior Publication Data

US 2012/0219304 A1 Aug. 30, 2012

(30) Foreign Application Priority Data

Feb. 24, 2011 (JP) ..... 2011-038288

(51) Int. Cl.
*G03G 15/00* (2006.01)

(52) U.S. Cl.
USPC ..... 399/10; 399/27

(58) Field of Classification Search
USPC ..... 399/10, 11, 27
See application file for complete search history.

(56) References Cited

U.S. PATENT DOCUMENTS

2008/0240745 A1* 10/2008 Hibino ..... 399/24

FOREIGN PATENT DOCUMENTS

JP 2004-226921 A 8/2004

* cited by examiner

*Primary Examiner* — Walter L Lindsay, Jr.
*Assistant Examiner* — Barnabas Fekete
(74) *Attorney, Agent, or Firm* — Panitch Schwarze Belisario & Nadel LLP

(57) ABSTRACT

An image forming apparatus includes a detachably replaceable image forming unit for forming an image on a medium, the image forming unit including a component for forming the image on the medium and a first storage section for storing life information, use amount information, and use purpose information of the component; a read-write section for reading and writing information in the first storage section; a life management section for managing life of the image forming unit; and a second storage section for storing the life information and the use amount information read from the first storage section by the read-write section; the life management section rewriting the life information stored in the first storage section by the first storage section in accordance with the use purpose information stored in the first storage section and the use amount information stored in the second storage section.

20 Claims, 7 Drawing Sheets

FIG.3

22

| ADDRESS | STORED INFORMATION |
|---|---|
| 1 | PRINTED PAGE COUNT NA |
| 2 | LIFE PAGE COUNT NB |
| 3 | TYPE TC |
| ⋮ | ⋮ |

FIG.4

31

| ADDRESS | STORED INFORMATION |
|---|---|
| 1 | PRINTED PAGE COUNT Na |
| 2 | LIFE PAGE COUNT Nb |
| ⋮ | ⋮ |

IMAGE FORMING APPARATUS

BACKGROUND OF THE INVENTION

1. Field of the Invention

The present invention relates to an image forming apparatus that manages the life of its component.

2. Description of the Related Art

Conventionally, an image forming apparatus such as a copier disclosed in Japanese Patent Publication No. 2004-226921 (Patent Document 1) below includes a replaceable expendable image forming unit and gives notice of replacement of the image forming unit performing life management.

The conventional image forming apparatus sometimes becomes impossible to detect automatically a lowered quality of printing caused by the expendable image forming unit. In other words, some faults are found by user's decision. If that type of fault occurs, the maintenance agency replaces the expendable item with a new one. If an expendable item having a given length of lifespan is provided, accurate life management becomes impossible after the expendable item is replaced.

SUMMARY OF THE INVENTION

An aspect of the present invention, a detachably replaceable image forming unit for forming an image on a medium, the image forming unit including a component for forming the image on the medium and a first storage section for storing life information, use amount information, and use purpose information of the component; a read-write section as a read-write section for reading and writing information in the first storage section; a life management section for managing life of the image forming unit; and a second storage section for storing the life information and the use amount information read from the first storage section by the read-write section; the life management section rewriting the life information stored in the first storage section by the first storage section in accordance with the use purpose information stored in the first storage section and the use amount information stored in the second storage section.

Another aspect of the present invention may be configures so that, in the above image forming apparatus, the second storage section stores lacking life information of the component in addition to the life information and the use amount information read from the first storage section by the read-write section, and the life management section rewrites the use amount information, in place of the life information, stored in the first storage section in accordance with the use purpose information stored in the first storage section and the use amount information and the lacking life information stored in the second storage section.

In one aspect of the image forming apparatus according to the present invention, a first storage section in an image forming unit holds use purpose information. When a maintenance personnel replaces a faulty image forming unit at the request of the user, the life of the replaced image forming unit is updated to "Life before replacement"—"Use amount before replacement".

This makes the total life of the expendable image forming unit after replacement consistent with that before replacement, enabling accurate life management.

In another aspect of the image forming apparatus according to the present invention, a second storage section holds lacking life information of a component. If the remaining usable amount of the image forming unit replaced for maintenance is smaller than the usable amount before replacement, the operation can be continued, and a new image forming unit does not need to be prepared on the site of replacement for maintenance. If the image forming unit replaced for maintenance reaches the end of its life, the user can be encouraged to make a request to the maintenance agency again.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIG. 3 is a schematic diagram showing the storage structure of a memory tag in FIG. 1;

FIG. 4 is a schematic diagram showing the storage structure of an EEPROM in FIG. 1;

DETAIL DESCRIPTION OF THE INVENTION

Further scope of applicability of the present invention will become apparent from the detailed description given hereinafter. However, it should be understood that the detailed description and specific examples, while indicating preferred embodiments of the invention, are given by way of illustration only, since various changes and modifications will become apparent to those skilled in the art from the detailed description.

Preferred embodiments of the present invention will become clear when the following description of preferred embodiments is read with reference to attached drawings. The drawings, however, are given for the purpose of description and do not confine the scope of the present invention.

First Embodiment (Configuration of First Embodiment)

Figure 2:
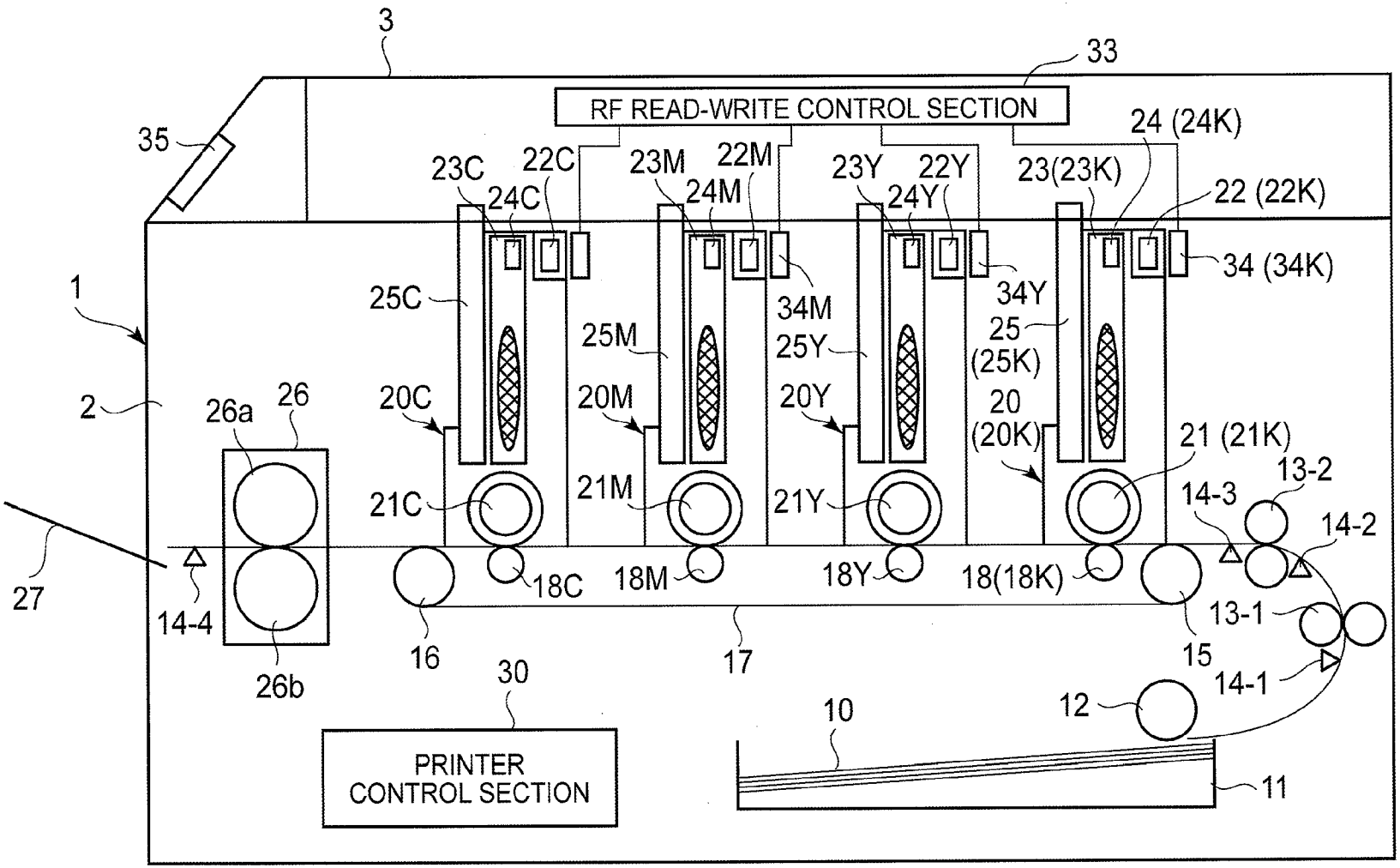
FIG. 2 is a schematic lateral sectional view showing the structure of a printer as an image forming apparatus according to the first embodiment of the present invention.

FIG. 2 is a schematic lateral sectional view showing the structure of a printer as an image forming apparatus according to a first embodiment of the present invention.

As the image forming apparatus, the printer 1 includes a housing 2 containing the printer body, and the housing 2 has a top cover section 3 that can be opened and closed, on its top.

A medium storage section 11 for storing a medium 10 such as printing paper is detachably mounted at the bottom of the housing 2. The medium storage section 11 has a paper feed roller 12 for discharging each sheet of the medium 10, on its medium discharge side. A first resist roller 13-1 and a second resist roller 13-2 for carrying the discharged medium 10 toward an image forming section are disposed downstream of the paper feed roller 12.

A feed sensor 14-1 for sensing the reaching of the medium 10 is disposed upstream of the first resist roller 13-1. Another feed sensor 14-2 for sensing the reaching of the medium 10 is disposed downstream of the second resist roller 13-2. A feed sensor 14-3 for sensing the timing at which the medium 10 reaches the image forming section is disposed downstream of the resist roller 13-2.

The image forming section is disposed downstream of the feed sensor 14-3. The image forming section forms an image on the medium 10 by an electrophotographic process including charging, exposure, development, transfer, and fusing (or fixing). The image forming section includes a feed belt 17 driven by feed rollers 15, 16, a plurality of transfer rollers 18, a plurality of image forming units 20, a plurality of light-emitting-diode (LED) heads 25 as exposure sections, and a fusing section 26.

The feed belt 17 is an endless belt stretched tightly between a pair of rollers 15, 16 and carries the medium 10 downstream of the image forming section. The plurality of transfer rollers 18 (such as a black transfer roller 18K, a yellow transfer roller 18Y, a magenta transfer roller 18M, and a cyan transfer roller 18C) are disposed at given intervals in the area enclosed by the feed belt 17.

A plurality of expendable image forming units 20 (such as a black image forming unit 20K, a yellow image forming unit 20Y, a magenta image forming unit 20M, and a cyan image forming unit 20C) are disposed on the upper side of the feed belt 17 in positions to face the corresponding transfer rollers 18 on the other side of the feed belt 17. The image forming units can be detached independently of the housing 2.

Each image forming unit 20 contains a photoconductive (or photosensitive) drum 21 (21K, 21Y, 21M, 21C) as an image carrying body, a first memory tag 22 (22K, 22Y, 22M, 22C) as a first storage section, and a toner cartridge 23 (23K, 23Y, 23M, 23C) as a developer cartridge containing toner of a given color as a developer.

The photoconductive drums 21 are disposed in positions to face the transfer rollers 18 on the other side of the feed belt 17. Each photoconductive drum 21 can form an electrostatic latent image corresponding to print data on its surface by having the surface charged by a charging section, which is not shown in the figure, and exposed to the LED head 25 (25K, 25Y, 25M, 25C) in accordance with the image data. The toner images formed on the surface of the photoconductive drums 21 are transferred onto the medium 10 by the transfer rollers 18.

The first memory tag 22 (22K, 22Y, 22M, 22C) includes a nonvolatile memory, where expendable item information including the following is stored: printed page count information, life page count information, and type information respectively as the use amount information, life information, and use purpose information of the corresponding image forming unit 20.

Each toner cartridge 23 (23K, 23Y, 23M, 23C) is detachably mounted in the corresponding image forming unit 20 (20K, 20Y, 20M, 20C) and is configured to supply the image forming unit 20 with toner it contains. The toner cartridge 23 includes a second memory tag 24 (24K, 24Y, 24M, 24C). The second memory tag 24 includes a nonvolatile memory, where expendable item information such as remaining toner level information is stored.

Each LED head 25 (25K, 25Y, 25M, 25C) illuminates the surface of the corresponding photoconductive drum 21 (21K, 21Y, 21M, 25C) in accordance with the print data and is mounted on the top cover section 3 that can be opened and closed. When the top cover section 3 is opened, the LED heads 25 are separated from the surface of the corresponding photoconductive drums 21; when the top cover section 3 is closed, the LED heads 25 come close to the surfaces of the corresponding photoconductive drums 21 and can illuminate the photoconductive drum surfaces.

The fusing section 26 is disposed downstream of the feed roller 16 and fuses the transferred toner images onto the medium 10 by heat and pressure. The fusing section 26 includes a heat roller 26*a* and a pressure roller 26*b* for pressing the medium 10 against the heat roller 26*a*, for example. A feed sensor 14-4 is disposed downstream of the fusing section 26. The feed sensor 14-4 senses the discharging of the medium 10 from the fusing section 26. A discharge stack section 27 is disposed downstream of the feed sensor 14-4, and the discharged medium 10 is stacked up there.

The paper feed roller 12, the first resist roller 13-1, the second resist roller 13-2, the photoconductive drums 21, the transfer rollers 18, and the fusing section 26 are driven by motors, which are not shown in the figure, and are configured to carry the medium 10 downstream in the printer.

The housing 2 contains a printer control section 30 as a life management section, a radio-frequency (RF) read-write control section 33 as a read-write section, a plurality of antenna sections 34 (such as a black antenna section 34K, a yellow antenna section 34Y, a magenta antenna section 34M, and a cyan antenna section 34C), and an operating panel 35.

The printer control section 30 program-controls the whole printer. The printer control section 30 is connected to the feed sensors 14-1 to 14-4, the LED heads 25, the RF read-write control section 33, the operating panel 35, and the like by cables, which are not shown in the figure. The antenna sections 34 are disposed in the vicinity of the corresponding image forming units 20 and connected to the RF read-write control section 33 by cables, which are not shown in the figure.

The RF read-write control section 33 is controlled by the printer control section 30, receives a control signal and power through cables, which are not shown in the figure. The RF read-write control section 33 functions as an interface (I/F) of the printer control section 30 and controls communication such as a data read from and a data write onto the memory tags 22 and 24. The memory tags 22 and 24 are disposed to face the corresponding antenna sections 34 and are configured to allow radio communicate with the RF read-write control section 33 through the corresponding antenna sections 34. The RF read-write control section 33 has a multiread capability with respect to the memory tags 22 and 24 through the corresponding antenna sections 34.

The operating panel 35 is disposed on the outer side of the housing 2 and includes a liquid crystal display (LCD) display section and an input section having a plurality of pushbutton switches, for example. The operating panel 35 informs the user of a message and allows the user to input a setting by using the switches.

Figure 1:
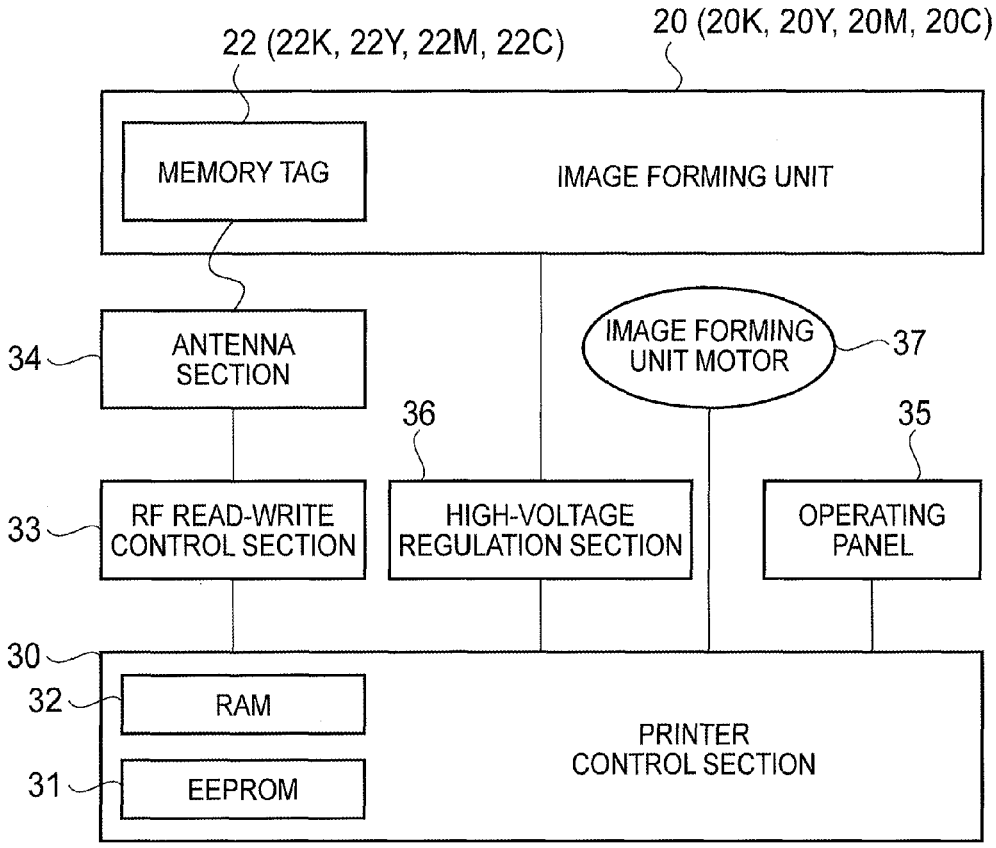
FIG. 1 is a block diagram showing the structure of a control mechanism of a printer 1 in FIG. 2, according to a first embodiment of the present invention.

FIG. 1 is a block diagram showing the structure of a control mechanism of the printer 1 in FIG. 2, in the first embodiment of the present invention.

The printer control section 30 has functions to control each operation of the printer 1 and to execute a variety of processes in accordance with a program for controlling the whole printer. The printer control section 30 includes a central processing unit (CPU), which is not shown in the figure, a non-volatile memory 31 (such as an electrically erasable programmable read only memory (EEPROM)) as a second storage section, a random access memory (RAM) 32 as a volatile memory for temporary storage, and input-output ports, which are not shown in the figure.

The printer control section 30 is connected to the RF read-write control section 33, the operating panel 35, a high-voltage regulation section 36, and an image forming unit motor 37 through the hidden input-output ports. The RF read-write control section 33 is connected to the antenna sections 34 (34K, 34Y, 34M, 34C), and the high-voltage regulation section 36 is connected to the image forming units 20 (20K, 20Y, 20M, 20C). The printer control section 30 is further connected to motors for driving the paper feed mechanism including the fusing section 26, the feed sensors 14-1 to 14-4, the paper feed roller 12, the resist rollers 13-1, 13-2, the feed belt 17 and for driving the fusing section 26, and the like, which are not shown in the figure, and control those motors.

FIG. 3 is a schematic diagram showing the storage structure of the memory tag 22 in FIG. 1.

The memory tag 22 (22K, 22Y, 22M, 22C) stores expendable item information such as the following, with given addresses: Printed page count information NA, life page count information NB, and type information TC respectively as the use amount information, life information, and use purpose information of the corresponding image forming unit 20 (20K, 20Y, 20M, 20C).

The printer control section 30 in FIG. 1 has a function to calculate the use amount of each image forming unit 20 as the printed page count information NA. The printed page count information NA is obtained by converting the use amount of the black, yellow, magenta, and cyan image forming units 20 (20K, 20Y, 20M, 20C) to the number of printed A4 pages in accordance with the drive time and drive speed of the image forming unit motor 37. If the value of the printed page count information NA exceeds a given page count specified as the printed page Count, the printer control section 30 judges that the life of the corresponding image forming unit 20 has ended, encourages the user to replace the image forming unit 20 via the operating panel 35 or the hidden interface, and stops printing. The revolution count information is updated on the RAM 32 in the printer control section 30 and stored in the EEPROM 31 successively during printing.

FIG. 4 is a schematic diagram showing the storage structure of the EEPROM 31 in FIG. 1.

The EEPROM 31 stores expendable item information such as the following, with given addresses: printed page count information Na indicating the use records of the corresponding image forming unit 20 and life page count information Nb.

(Operation of Entire Printer 1 in First Embodiment)

In the printer 1 in FIG. 2, each sheet of the medium 10 contained in the medium storage section 11 is fed by paper feed roller 12 and carried to the black image forming unit 20K by the resist rollers 13-1, 13-2. The surface of the rotating photoconductive drum 21K in the black image forming unit 20K is charged by the hidden charging section. When the charged part comes below it, the LED head 25K illuminates to form an electrostatic latent image based on the image data of the charged part. The electrostatic latent image is developed by a development roller, which is not shown in the figure, and a black (K) toner image is formed. The black (K) toner image is transferred onto the medium 10 by the transfer roller 18K under the feed belt 17.

When the medium 10 passes through the image forming units 20Y, 20M, 20C in that order, yellow (Y), magenta (M), and cyan (C) toner images are transferred one after another onto the medium 10 in the same manner. The overlapping toner images are fused by heat and pressure by the fusing section 26, and the sheet is discharged to the external discharge stack section 27.

In the process described above, the printer control section 30 controls motors such as the image forming unit motor 37 in accordance with what are sensed by the feed sensors 14-1 to 14-4, drives the paper feed roller 12, first resist roller 13-1, second resist roller 13-2, photoconductive drums 21, transfer rollers 18, and fusing section 26 to carry the medium 10 at a given timing, and has a color image formed on the medium 10.

(Operation of Printer Control Section 30 in First Embodiment)

Figure 5:
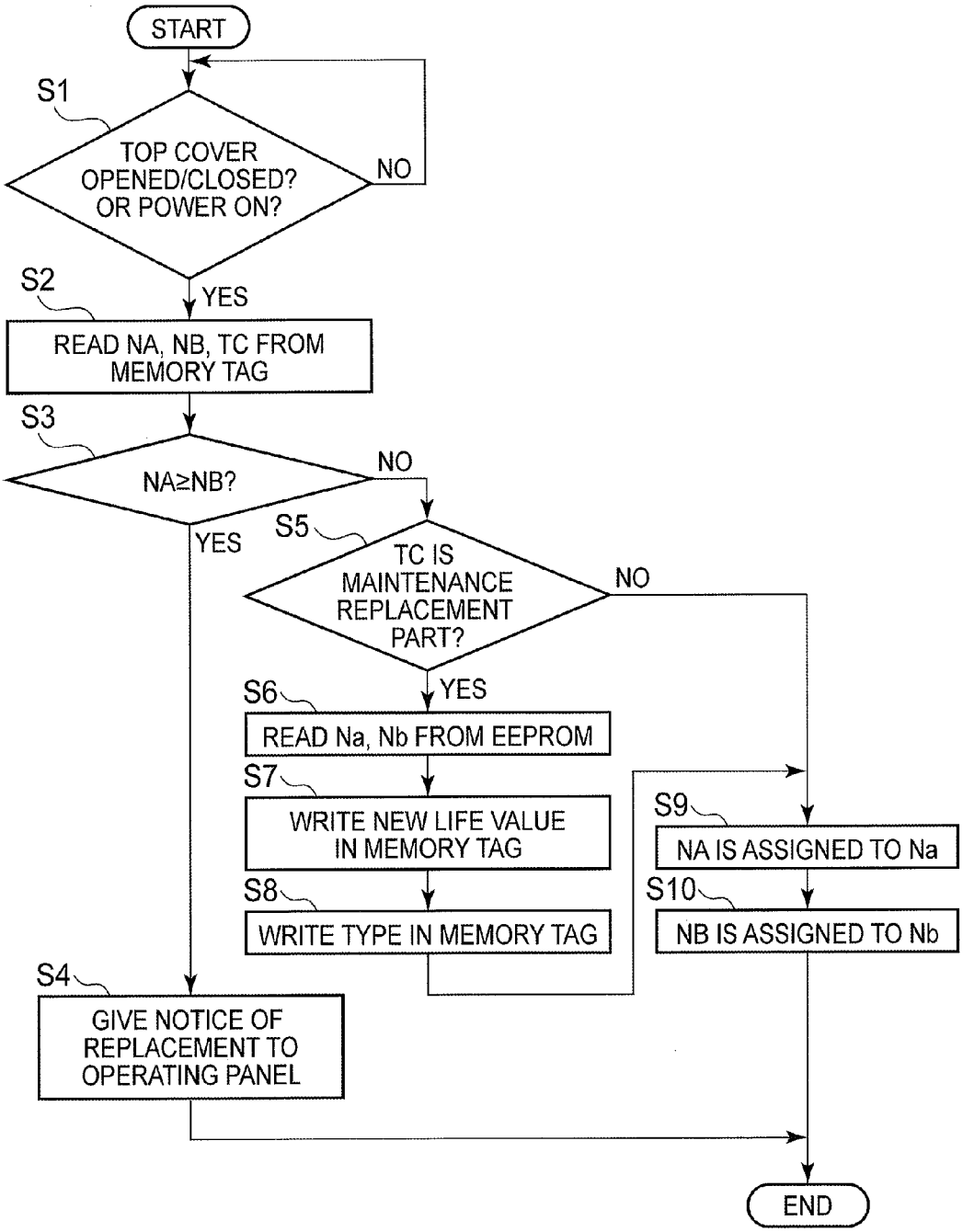
FIG. 5 is a flowchart illustrating an operation when a printer control section in FIG. 1 reads the memory tags in image forming units.

FIG. 5 is a flowchart illustrating an operation when the printer control section 30 in FIG. 1 reads the memory tags 22 in the image forming units 20.

The operation to read the memory tags 22 is executed when the printer 1 is turned on and when the top cover section 3 is opened or closed. Since the life information of the image forming unit managed by the printer body must be updated when the image forming unit 20 is replaced, the printer control section 30 reads information stored in the memory tags 22 and rewrites the information stored in the EEPROM 31 accordingly.

In the process illustrated in FIG. 5, the printer control section 30 judges in step S1 whether the top cover section 3 is opened or closed or whether the printer 1 is turned on. If Yes, the process proceeds to step S2. If No, the process returns to step S1. In step S2, the printer control section 30 reads information from the memory tags 22 through the RF read-write control section 33 and the antenna sections 34. The read information includes the printed page count information NA, life page count information NB, and type information TC of the black, yellow, magenta, cyan image forming units 20K, 20Y, 20M, 20C. The printer control section 30 stores the information temporarily on the ROM 32, and goes to step S3.

The printer control section 30 judges in step S3 whether the printed page count NA is greater than or equal to the life page count NB. If Yes, the process proceeds to step S4. If No, the process proceeds to step S5. In step S4, the printer control section 30 gives notice of replacement of the image forming unit 20 to the operating panel 35. Then, the process proceeds. In step S5, the printer control section 30 judges whether the type information TC of the image forming unit 20 is "maintenance replacement part". If Yes, the process proceeds to step S6. If No, the process proceeds to step S9.

In step S6, the printer control section 30 reads the printed page count Na and the life page count Nb of the image forming unit 20 from the EEPROM 31 and stores the information temporarily in the RAM 32, and goes to step S7. In step S7, the printer control section 30 writes a new life value in the memory tag 22 through the RF read-write control section 33 and the antenna section 34. In the write operation, the value obtained by calculating "life page count Nb"−"printed page count Na"

is assigned to the life page count NB of the image forming unit 20. Then, the process proceeds to step S8.

In step S8, the printer control section 30 writes the type information in the memory tag 22, through the RF read-write control section 33 and the antenna section 34. In the write operation, "standard part" is assigned to the type information TC of the image forming, unit 20. Then, the process proceeds to step S9. In step S9, the printer control section 30 writes information in the EEPROM 31. In the write operation, the printed page count NA temporarily stored in the RAM 32 is assigned to the printed page count Na of the image forming unit 20. Then, the process proceeds to step S10.

In step S10, the printer control section 30 writes information in the EEPROM 31. In the write operation, the life page count NB temporarily stored in the RAM 32 is assigned to the life page count Nb of the image forming unit 20. Then, the process ends.

Figure 6:
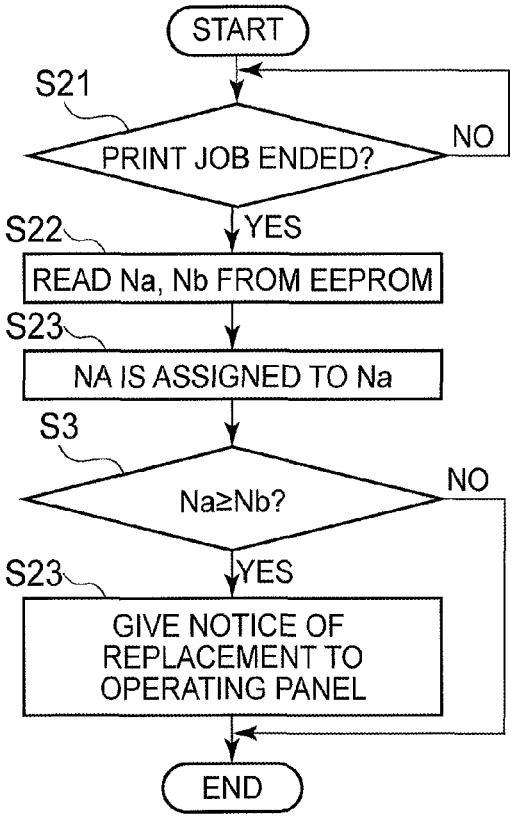
FIG. 6 is a flowchart illustrating an operation when the printer control section in FIG. 1 writes the memory tags in the image forming units.

FIG. 6 is a flowchart illustrating an operation when the printer control section 30 in FIG. 1 writes the memory tags 22 in the image forming units 20.

The printer control section 30 writes the memory tags 22 when a print job of the printer 1 ends. The operation is executed when the revolution count of the use amount information of the image forming unit 20 increases and when the printer 1 enters the standby state.

As the print job proceeds during printing, the printer control section 30 overwrites a value of the printed page count in the print job on "printed page count Na" stored in the EEPROM 31 (that is, replaces a value of "printed page count Na" stored in the EEPROM 31 by a value of the printed page count in the print job), thereby incrementing the value of "printed page count Na" stored in the EEPROM 31. Therefore, the value of "printed page count Na" of the image forming unit 20 is replaced by the newest value successively.

In the process, the printer control section 30 judges in step S21 whether the print job of the printer 1 has ended. If Yes, the process proceeds to step S22. If No, the process proceeds to step S21. In step S22, the printer control section 30 reads the printed page count Na and the life page count Nb from the EEPROM 31, stores the information temporarily in the RAM 32, and goes to step S23. In step S23, the printer control section 30 writes a new printed page count in the memory tag 22, via the RF read-write control section 33 and the antenna section 34. In the write operation, the printed page count Na temporarily stored in the RAM 32 is assigned to the printed page count NA. Then, the process proceeds to step S24.

In step S24, the printer control section 30 judges whether the printed page count Na is greater than or equal to the life page count Nb of the image forming unit 20. If Yes, the process proceeds to step S25. If No, the process ends. In step S25, the printer control section 30 gives notice of replacement of the image forming unit 20 to the operating panel 35, then the process ends.

For example, when a new image forming unit 20, which is not maintenance replacement part, is mounted on the printer 1, "printed page count NA" and "life page count NB" stored in the memory tag 22 are written in the EEPROM 31. At this time, if the image forming unit 20 is a new one, NA=0 and NB=30000 are satisfied and therefore Na=0 and Nb=30,000 are stored in the EEPROM 31.

Since the value of the printed page count Na stored in the EEPROM 31 is incremented (that is, updated) by overwriting the value of "printed page count NA" in place of the value of the printed page count Na stored in the EEPROM 31, when the print job proceeds during printing and "printed page count NA" of the image forming unit 20 reaches 10,000 counts, "Na=10,000" and "Nb" are stored in the EEPROM 31.

A specific example will be described with reference to the flowchart in FIG. 5.

The specific example assumes that the user has requested the replacement of the image forming unit 20 (1) while the stored information tells that 20,000 more pages would be printable, that is, the memory tag 22 (1) of the image forming unit 20 (1) stores "printed page count NA=10,000",
"life page count NB=30,000", and
"type information TC=standard part", and the EEPROM 31 stores "printed page count Na=10,000" and
"life page count Nb=30,000".

The memory tag 22 (2) of the replacement image forming unit 20 (2) stores "printed page count NA=0",
"life page count NB=30,000", and
"type information TC=maintenance replacement part".

The maintenance personnel opens the top cover section 3, replaces the unit with the image forming unit 20 (2), and closes the top cover section 3.

In step S2 in FIG. 5, the printer control section 30 reads

"printed page count NA=0",
"life page count NB=30,000", and
"type information TC=maintenance replacement part"

from the memory tag 22 (2), and stores the information temporarily in the RAM 32. In step S3, the printer control section 30 judges whether the printed page count NA is greater than or equal to the life page count NB. Since the judgment is No, the process proceeds to step S5.

In step S5, the printer control section 30 reads the type information TC of the image forming unit 20 (2) from the RAM 32 and judges whether the type information TC is "maintenance replacement part". Since the judgment is Yes, the process proceeds to step S6. In step S6, the printer control section 30 reads "printed page count Na=10,000" and
"life page count Nb=30,000"

from the EEPROM 31, and stores the information temporarily in the RAM 32. In step S7, the printer control section 30 writes "20,000" obtained by calculating "life page count Nb"−"printed page count Na"

as a new life value of the life page count NB in the memory tag 22 (2).

In step S8, the printer control section 30 writes "standard part" as the type information TC in the memory tag 22 (2). In step S9, the printer control section 30 writes "0" as the printed page count Na in the EEPROM 31. In step S10, the printer control section 30 writes "20,000" as the life page count Nb in the EEPROM 31. If the type information TC of the replaced image forming unit 20 (2) is "maintenance replacement part", the life page count NB of the memory tag 22 (2) is rewritten to "20,000", and the number of printable pages remains 20,000.

The printer control section 30 controls the high-voltage bias value output from the high-voltage regulation section 36 to correct a temporal change in accordance with the use amount of the image forming unit 20. This ensures a stable picture quality from the beginning to the end of the life. Since the revolution count indicating the use amount of the image forming unit 20 (2) replaced for maintenance is held "0", the optimum high-voltage bias value is maintained.

(Effect of First Embodiment)

The first embodiment produces the following effects (a) and (b).

(a) Since the memory tag 22 in the image forming unit 20 holds the type information TC indicating that it is a maintenance replacement part, when a faulty image forming unit 20 is replaced as requested by the user, the maintenance personnel changes the life of the replaced image forming unit 20 to a value obtained by calculating "life before replacement"−
"use amount before replacement".

The total life of the expendable image forming unit 20 after replacement agrees with that before replacement, and correct life management can be performed.

(b) Since the antenna sections 34 and the corresponding memory tags 22, 24 exchange information by radio, electrical wiring in the printer 1 can be simplified.

Second Embodiment

In the first embodiment, when the replacement image forming unit 20 (2) differs from the standard image forming unit 20 (1) just in type setting, even if the unit is sound, the unit is considered to have reached the end of its life before the use amount reaches the original number of printable pages. Accordingly, the unit cannot be reused up to the original number of printable pages some time later. A second embodiment is configured to solve the problem.

(Configuration of Second Embodiment)

Figure 7:
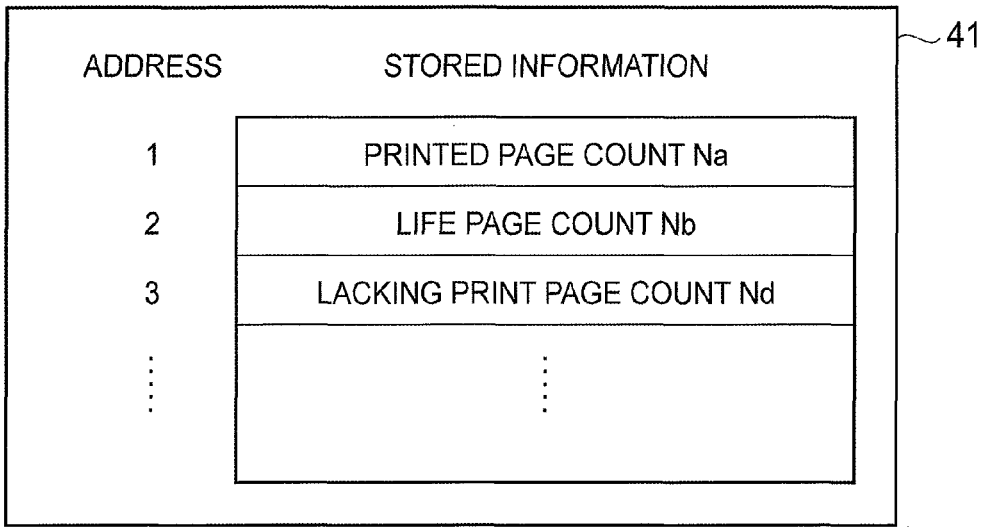
FIG. 7 is a schematic diagram showing the storage structure of an EEPROM in a second embodiment of the present invention.

FIG. 7 is a schematic diagram showing the storage structure of an EEPROM in the second embodiment of the present invention.

In the second embodiment, the printer control section 30 in FIG. 1 contains an EEPROM 41 storing different information, instead of the EEPROM 31 in FIG. 1 in the first embodiment. The EEPROM 41 stores expendable item information such as the printed page count information Na, which is the use record of the mounted image forming unit 20, life page count information Nb, and lacking print page count information Nd, with given addresses, for example.

The second embodiment will be described on the supposition that the maintenance agency has a means for rewriting the type information TC of the used image forming unit 20 the agency has collected, from "standard part" to "maintenance replacement part". The used image forming unit 20 (2) is reused as a maintenance replacement part. The lacking print page count information Nd is lacking life information of the replaced image forming unit 20 (2) if the remaining usable amount is smaller than that before replacement.

The configuration of the printer 1 in FIGS. 1 and 2 and the structure of the memory tag 22 in FIG. 3 are the same as those in the first embodiment.

(Operation in Second Embodiment)

Figure 8:
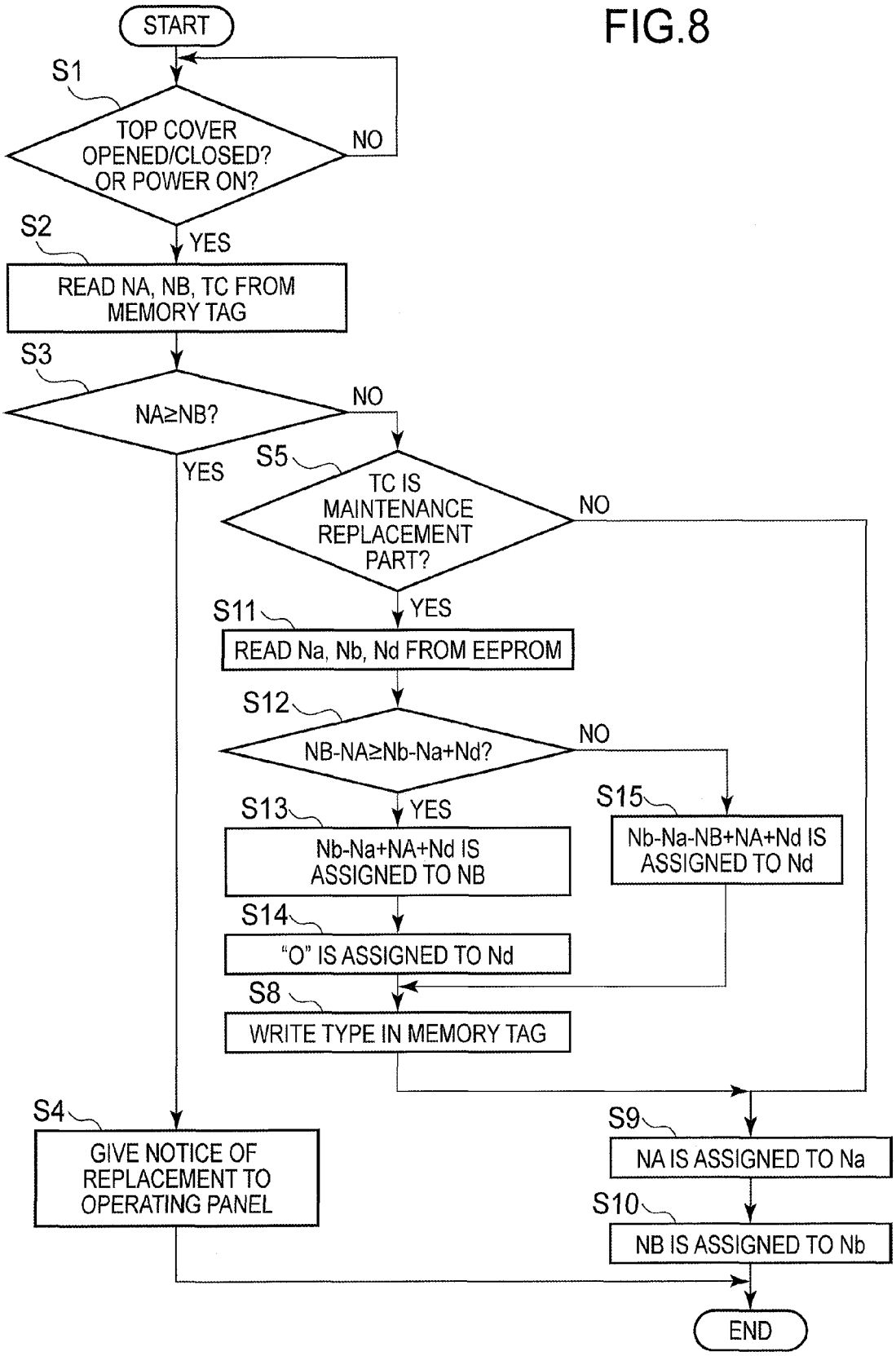
FIG. 8 is a flowchart illustrating an operation when the printer control section in FIG. 1 reads the memory tags in the image forming units.

FIG. 8 is a flowchart illustrating an operation when the printer control section 30 in FIG. 1 reads the memory tags 22 in the image forming units 20. Elements identical to elements in FIG. 5 of the first embodiment are given the same reference numerals.

The flowchart in FIG. 8 in the second embodiment differs from the flowchart in FIG. 5 in the first embodiment in that steps S11 to S15 are provided instead of steps S6, S7.

The second embodiment is the same as the first embodiment in that the operation to read the memory tags 22 is executed when the printer 1 is turned on and when the top cover section 3 is opened or closed. When the image forming unit 20 is replaced, the life information managed by the printer body must be updated. So, the information stored in the memory tags 22 is read, and the information stored in the EEPROM 41 is rewritten accordingly.

As in steps S1 to S5 in the first embodiment, the printer control section 30 judges in step S1 whether the top cover section 3 is opened or closed or whether the power is switched on. If Yes, the process proceeds to step S2. If No, the process returns to step S1. In step S2, the printer control section 30 reads the printed page count NA, life page count NB, and type information TC from the memory tags 22 through the RF read-write control section 33 and antenna sections 34, stores the information temporarily in the RAM 32, and goes to step S3.

The printer control section 30 judges in step S3 whether the printed page count NA is greater than or equal to the life page count NB. If Yes, the process proceeds to step S4. If No, the process proceeds to step S5. In step S4, the printer control section 30 gives notice of replacement of the image forming unit 20 to the operating panel 35 and ends the process. In step S5, the printer control section 30 judges whether the type information TC is "maintenance replacement part". If Yes, the process proceeds to step S11. If No, the process proceeds to step S9.

In step S11, the printer control section 30 reads the printed page count Na, life page count Nb, lacking print page count Nd from the EEPROM 41, stores the information temporarily in the RAM 32, and goes to step S12. The printer control section 30 judges in step S12 whether the remaining use amount of the newly replaced image forming unit 20 (2) obtained by calculating "life page count NB"−"printed page count NA"

is greater than or equal to the remaining use amount of the removed image forming unit 20 (1) obtained by calculating $$\text{"life page count } Nb\text{"} - \text{"printed page count } Na\text{"} + \text{"lacking print page count } Nd\text{"} (= Nb - Na + Nd).$$

If Yes, the process proceeds to step S13. If No, the process proceeds to step S15.

In step S13, the printer control section 30 writes a new life value in the memory tag 22. In the write operation, the value obtained by calculating $$\text{"life page count } Nb\text{"} - \text{"printed page count } Na\text{"} + \text{"printed page count } Na\text{"} + \text{"lacking print page count } Nd\text{"} (= Nb - Na + NA + Nd)$$

is assigned to the life page count NB. Then, the process proceeds to step S14. In step S14, the printer control section 30 writes the EEPROM 41. In the write operation, "0" is assigned to the lacking print page count information Nd. Then, the process proceeds to step S8. In step S8, the printer control section 30 writes the type information in the memory tags 22, as in the first embodiment. In the write operation, "standard part" is written as the type information TC. Then, the process proceeds to step S9.

In step S15, the printer control section 30 writes the EEPROM 41. In the write operation, the value obtained by calculating $$\text{"life page count } Nb\text{"} - \text{"printed page count } Na\text{"} - \text{"life page count } NB\text{"} + \text{"printed page count } NA\text{"} + \text{"lacking print page count } Nd\text{"} (= Nb - Na - NB + NA + Nd)$$

is assigned to the lacking print page count information Nd. Then, the process proceeds to step S8.

In step S9, the printer control section 30 writes the EEPROM 41, as in the first embodiment. In the write operation, the printed page count NA temporarily stored in the RAM 32 is assigned to the printed page count Na. Then, the process proceeds to step S10. In step S10, the printer control section 30 writes information in the EEPROM 41, as in the first embodiment. In the write operation, the life page count NB temporarily stored in the RAM 32 is assigned to the life page count Nb. Then, the process ends.

Figure 9:
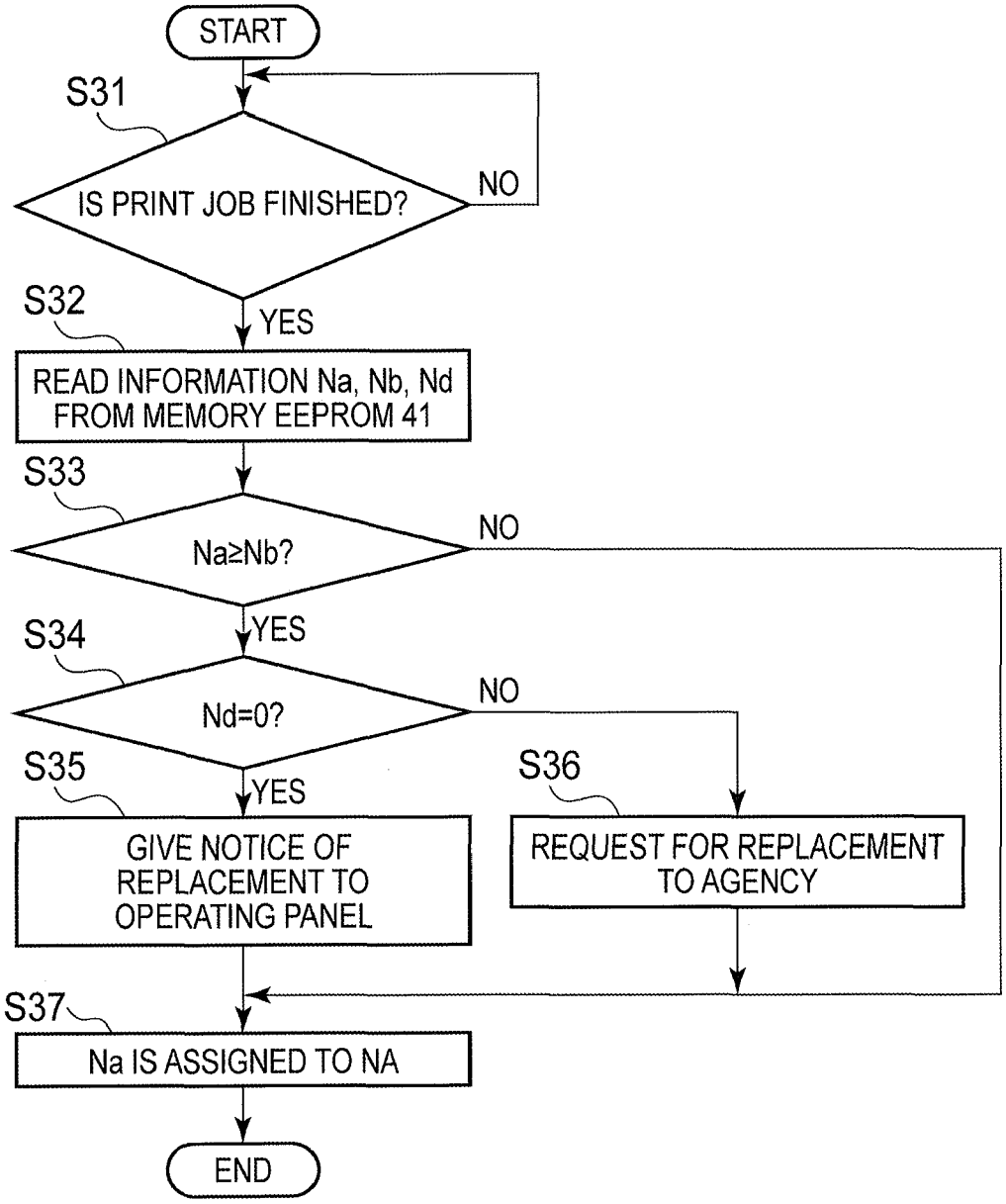
FIG. 9 is a flowchart illustrating an operation when the printer control section in FIG. 1 writes the memory tags in the image forming units.

FIG. 9 is a flowchart illustrating an operation when the printer control section 30 in FIG. 1 writes the memory tags 22 in the image forming units 20.

The printer control section 30 writes the memory tags 22 when the print job of the printer 1 ends, as in the first embodiment. That is, the write operation is executed when the revolution count of the use amount information of the image forming unit 20 increases and when the printer 1 enters the standby state.

In step S31 of the process, the printer control section 30 judges whether the print job has ended. If Yes, the process proceeds to step S32. If No, the process returns to step S31. In step S32, the printer control section 30 reads the printed page count Na, life page count Nb, and lacking print page count Nd from the EEPROM 41, stores the information temporarily in the RAM 32, and goes to step S33.

In step S33, the printer control section 30 judges whether the printed page count Na is greater than or equal to the life page count Nb. If Yes, the process proceeds to step S34. If No, the process proceeds to step S37. In step S34, the printer control section 30 judges whether the lacking print page count Nd is "0". If Yes, the process proceeds to step S35. If No, the process proceeds to step S36.

In step S34, the printer control section 30 gives notice of replacement of the image forming unit 20 to the operating panel 35 and then goes to step S37. In step S36, the printer control section 30 gives the operating panel 35 notice of replacement of the image forming unit 20 and a request for a replacement image forming unit 20 to the maintenance agency and then goes to step S37.

In step S37, the printer control section 30 writes a new printed page count on the memory tags 22 and ends the process. In the write operation, the printed page count Na temporarily stored in the RAM 32 is assigned to the printed page count NA.

The printer control section 30 calculates the use amount of the cyan (C), magenta (M), yellow (Y), and black (K) image forming units 20 as the printed page count information. The printed page count information is obtained by converting the use amount to the number of printed A4 pages in accordance with the drive time and drive speed of the image forming unit motor 37. If the use amount exceeds the life value, the printer control section 30 judges that the image forming unit 20 has reached the end of its life, encourages the user to replace the unit, through the operating panel 35 or the hidden interface, and stops printing. The printed page count information is updated on the RAM 32 and stored successively in the EEPROM 41 during printing.

A specific example will be described with reference to the flowcharts in FIGS. 8 and 9.

The specific example assumes that the user has requested the replacement of the image forming unit 20 (1) while the stored information tells that 20,000 more pages would be printable, that is, the memory tag 22 (1) of the image forming unit 20 (1) stores "printed page count NA=10,000", "life page count NB=30,000", and "type information TC=standard part", and the EEPROM 41 stores "printed page count Na=10,000", "life page count Nb=30,000", and "lacking print page count Nd=0".

The memory tag 22 (2) of the replacement image forming unit 20 (2) stores "printed page count NA=15,000", "life page count NB=30,000", and "type information TC=maintenance replacement part".

The maintenance personnel opens the top cover section 3, replaces the unit with the image forming unit 20 (2), and closes the top cover section 3.

In step S2 in FIG. 8, the printer control section 30 reads

"printed page count NA=15,000",

"life page count NB=30,000", and

"type information TC=maintenance replacement part"

from the memory tag 22 (2) and stores the information temporarily in the RAM 32. In step S3, the printer control section 30 judges whether the printed page count NA stored in the RAM 32 is greater than or equal to the life page count NB. Since the judgment is No, the process proceeds to step S5.

In step S5, the printer control section 30 reads the type information TC of the image forming unit 20 (2) from the RAM 32 and judges whether the type information TC is "maintenance replacement part". Since the judgment is Yes, the process proceeds to step S11. In step S11, the printer control section 30 reads "printed page count Na=10,000", "life page count Nb=30,000", and "lacking print page count Nd=0"

from the EEPROM 41, and stores the information temporarily in the RAM 32.

In step S12, the printer control section 30 judges whether the value obtained by calculating "life page count NB"−"printed page count NA"

is greater than or equal to the value obtained by calculating $$\text{"life page count } Nb\text{"} - \text{"printed page count } Na\text{"} + \text{"lacking print page count } Nd\text{"} (= Nb - Na + Nd).$$

Since the judgment is No, the process proceeds to step S15. In step S15, the printer control section 30 writes "5,000" as the lacking print page count Nd in the EEPROM 41. In step S8, the printer control section 30 writes "standard part" as the type information TC in the memory tags 22 (2).

In step S9, the printer control section 30 writes the value "15,000" of the printed page count NA as the printed page count Na in the EEPROM 41. In step S10, the printer control section 30 writes the value "30,000" of the life page count NB=as the life page count Nb in the EEPROM 41.

While the remaining printable page count obtained by calculating NB−NA is "20,000", the type information TC of the replaced unit is "maintenance replacement part", and the remaining printable page count of the maintenance replacement part obtained by calculating Nb−Na is "15,000", which is 5,000 lower. The printer control section 30 writes "5,000" as the lacking print page count Nd in the EEPROM 41.

If the user uses the image forming unit 20 (2) until the end of its life, the printed page count Na reaches "30,000".

In step S33 in FIG. 9, the printer control section 30 judges whether the printed page count Na is greater than or equal to the life page count Nb, both read from the EEPROM 41. Since the judgment is Yes, the process proceeds to step S34. In step S34, the printer control section 30 judges whether the lacking print page count Nd read from the EEPROM 41 is "0". Since the judgment is No, the process proceeds to step S36.

In step S36, the printer control section 30 gives the operating panel 35 notice of replacement of the image forming unit 20 and a request for a replacement image forming unit 20 to the maintenance agency. In step S37, the printer control section 30 writes a new printed page count "30,000" as the printed page count NA in the memory tag 22(2), and the process ends.

(Effect of Second Embodiment)

In the second embodiment, since the EEPROM 41 has a region for storing the lacking print page count of the image forming unit, if the remaining usable amount of the image forming unit 20 (2) replaced for maintenance falls below the usable amount before replacement, the operation can be continued. This eliminates the need for preparing a new image forming unit 20 at the site of replacement for maintenance. When the image forming unit 20 (2) replaced for maintenance reaches the end of its life, the user can be encouraged to make a request for another unit to the maintenance agency.

(Modifications to First and Second Embodiments)

The present invention is not confined by the first and second embodiments described above, and a variety of utilization forms and modifications such as (I) to (IV) described below, are allowed.

(I) The entire configuration of the printer 1 and the configuration of the image forming unit 20 may differ from the ones shown in the attached drawings.

(II) The printer control section 30 may read and write information of the memory tags 22, 24 by using a lead and a contact terminal.

(III) The EEPROMs 31, 41 may be a storage section using another type of nonvolatile memory.

(IV) Although the image forming apparatus is described as the printer 1 in the first and second embodiments, the present invention can be applied to office automation equipment including other image forming apparatuses such as a facsimile apparatus, a copier, multifunction peripheral that performs life management of an expendable item.

What is claimed is:

1. An image forming apparatus comprising:

a first image forming unit for forming an image on a medium, the first image forming unit including a component for forming the image on the medium and a first image forming unit storage section for storing life information, use amount information, and use purpose information of the component, the first image forming unit being detachably replaceable;

a read-write section for reading and writing information in the first image forming unit storage section;

a life management section for managing life of the first image forming unit; and an image forming apparatus storage section for storing the life information and the use amount information read from the first image forming unit storage section by the read-write section, wherein after the first image forming unit is replaced by a second image forming unit different from the first image forming unit, the life management section causes the read-write section to read the use amount information of the first image forming unit from the image forming apparatus storage section, calculates a usable amount according to the use amount information read from the image forming apparatus storage section, and causes the read-write section to write the usable amount to a second image forming unit storage section of the second image forming unit.

2. An image forming apparatus according to claim 1, wherein:

the image forming apparatus storage section stores lacking life information of the component in addition to the life information and the use amount information read from the first image forming unit storage section by the read-write section, the lacking life information indicating difference between the usable amount and another usable amount calculated according to storing life information and use amount information stored in the second image forming unit storage section of the second image forming unit, the lacking life information being stored in a case where the usable amount is greater than the other usable amount; and the life management section rewrites the use amount information, in place of the life information, stored in the first image forming unit storage section in accordance with the use purpose information stored in the first image forming unit storage section and the use amount information and the lacking life information stored in the image forming apparatus storage section.

3. The image forming apparatus of claim 1, wherein the image forming unit is an expendable item; and the first image forming unit storage section and the image forming apparatus storage section are each configured by a nonvolatile memory.

4. The image forming apparatus of claim 1, wherein the read-write section reads and writes the information in the first image forming unit storage section by radio.

5. The image forming apparatus of claim 1, wherein the read-write section controls the image forming unit and the image forming apparatus storage section in accordance with a program for controlling the entire image forming apparatus.

6. The image forming apparatus of claim 1, wherein:

the image forming apparatus storage section stores a printed page count as the use amount information, and the printed page count is incremented each time the image is formed on the medium.

7. The image forming apparatus of claim 1, wherein:

the life information includes a life page count;

the use amount information includes a printed page count; and the use purpose information includes type information of the component.

8. The image forming apparatus of claim 2, wherein:

the image forming unit is an expendable item; and the first image forming unit storage section and the image forming apparatus storage section are each configured by a nonvolatile memory.

9. The image forming apparatus of claim 2, wherein the read-write section reads and writes the information in the first image forming unit storage section by radio.

10. The image forming apparatus of claim 2, wherein the read-write section controls the image forming unit and the image forming apparatus storage section in accordance with a program for controlling the entire image forming apparatus.

11. The image forming apparatus of claim 2, wherein:

the life information includes a life page count;

the use amount information includes a printed page count;

the use purpose information includes type information of the component; and the lacking life information includes a lacking print page count.

12. The image forming apparatus of claim 1, wherein:

the read-write section reads the use amount information of the first image forming unit and the life information of the first image forming unit from the image forming apparatus storage section, and writes, to the second image forming unit storage section, a value gained by subtracting a use amount from a life value, the use amount being indicated by the use amount information read from the image forming apparatus storage section, the life value being indicated by the life information read from the image forming apparatus storage section.

13. The image forming apparatus of claim 1, wherein:

the read-write section reads the use amount information of the first image forming unit and the life information of the first image forming unit from the image forming apparatus storage section, and writes, to the second image forming unit storage section, a value gained by subtracting a printed page count from a life page count, the printed page count being indicated by the read use amount information read from the image forming apparatus storage section, the life page count being indicated by the read life information read from the image forming apparatus storage section.

14. The image forming apparatus of claim 1, wherein:

when predetermined information is stored in the second image forming unit storage section, the life management section causes the read-write section to store the usable amount in the second image forming unit storage section; and when the predetermined information is not stored in the second image forming unit storage section, the life management section does not cause the read-write section to store the usable amount in the second image forming unit storage section.

15. The image forming apparatus of claim 14, wherein the predetermined information is information indicating that the second image forming unit is a maintenance replacement part.

16. The image forming apparatus comprising:

a first replacement unit; and a body from which the first replacement unit is detachable, wherein the body comprises a body storage section for storing first replacement unit information, and a printer control section for managing a use amount of the first replacement unit; and after the first replacement unit is replaced by a second replacement unit different from the first replacement unit, the printer control section reads the first replacement unit information of the first replacement unit from the body storage section, specifies the use amount of the first replacement unit based on the first replacement unit information read from the body storage section, calculates a usable amount of the second replacement unit according to the specified use amount, and stores the usable amount in a second replacement unit storage section of the second replacement unit.

17. The image forming apparatus of claim 16, further comprising a read-write section for reading and writing information in the body storage section: wherein the read-write section reads the first replacement unit information of the first image forming unit from the body storage section, and writes, to the second image forming unit storage section, a value gained by subtracting a use amount from a life value, the use amount and the life value being indicated by the first replacement unit information read from the body storage section.

18. The image forming apparatus of claim 16, further comprising a read-write section for reading and writing information in the body storage section: wherein the read-write section reads the first replacement unit information of the first image forming unit from the body storage section, and writes, to the second image forming unit storage section, a value gained by subtracting a printed page count from a life page count, the printed page count and the life page count being indicated by the first replacement unit information read from the body storage section.

19. The image forming apparatus of claim 16, further comprising a read-write section for reading and writing information in the body storage section, wherein:

when predetermined information is stored in the second image forming unit storage section, the printer control section causes the read-write section to store the usable amount in the second image forming unit storage section; and when the predetermined information is not stored in the second image forming unit storage section, the printer control section does not cause the read-write section to store the usable amount in the second image forming unit storage section.

20. The image forming apparatus of claim 19, wherein the predetermined information is information indicating that the second replacement unit is a maintenance replacement part.

* * * * *